US005167357A

United States Patent [19]

Shih

[11] Patent Number: 5,167,357

[45] Date of Patent: Dec. 1, 1992

[54] ADHESIVE TAPE HOLDER

[76] Inventor: Sheng-Hsiung Shih, 4F, No. 292, Sec. 2, Chien-Kuo S Rd.,, Taipei, Taiwan

[21] Appl. No.: 771,358

[22] Filed: Oct. 4, 1991

[51] Int. Cl.[5] ..... B26F 3/02

[52] U.S. Cl. ..... 225/20; 225/47; 225/80

[58] Field of Search ..... 225/20, 39, 46, 47, 225/77, 80, 56, 57; 242/55.2, 55.53, 56 R

[56] References Cited

U.S. PATENT DOCUMENTS

| | | | |
|---|---|---|---|
| 2,125,736 | 8/1938 | Murray | 225/20 |
| 2,333,378 | 11/1943 | Jackson | 225/47 X |
| 2,591,559 | 4/1952 | Krueger | 225/47 X |
| 3,972,459 | 8/1976 | Cooper | 225/47 |
| 4,244,503 | 1/1981 | Kramer | 225/46 |
| 4,401,248 | 8/1983 | Helms | 225/47 |
| 4,752,023 | 6/1988 | Lin | 225/80 X |

*Primary Examiner*—Frank T. Yost
*Assistant Examiner*—Eugenia Jones
*Attorney, Agent, or Firm*—Poms, Smith, Lande & Rose

[57] ABSTRACT

An adhesive tape holder comprising a base cylinder constituted by two cylinders releasably connected together end by end. Each of the cylinders has an extension and the ends of the extensions are connected together by a knife seat with a saw-like knife mounted thereon. One of the extensions is constituted by two parts hinged together so that the cylinder associated therewith can be released and open to have a roll of adhesive tape disposed on the base cylinder. The saw-like knife is covered by a slidable safety lid to prevent the knife from hurting the user when not in use. Attached on one of the extensions is a tape tip retaining post which is rotatable in one direction so as to prevent the tape tip from losing contact with the post.

7 Claims, 4 Drawing Sheets

ADHESIVE TAPE HOLDER

FIELD OF THE INVENTION

The present invention relates generally to an adhesive tape holder.

BACKGROUND OF THE INVENTION

Using adhesive tapes to secure boxes or other stuffs is convenient and practical. Conventionally, adhesive tapes are commercially available in the form of a roll, namely a long strip of tape wound on an axle or a hollow cylinder. The conventional tape holder comprises a short cylinder on which a roll of the adhesive tape is loosely and rotatably disposed to provide a handy way of feeding out the tape, a rotatable post for retaining the tip of the tape to provide an easy way of using the tape and a knife for cutting off the tape. The conventional tape holder has disadvantages:

(1) the conventional tape holder is constituted by a number of parts riveted together and because of the requirements of strength, those parts are usually made of metal; thus the manufacturing cost and weight are increased and the tape holder is not fit for long time use.

(2) The rotatable retaining post is rotatable in both clockwise and counterclockwise directions and thus the tape is rotatable back to have the tip thereof lose contact with the retaining post so that it is necessary to get the tip again from the whole roll of tape in the next use.

(3) The knife used to cut off the tape is exposed to the user and thus it is possible to hurt the user.

(4) The tape is supported by the tape holder unsymmetrically and thus the holder is deformed and damaged very easily.

OBJECTS OF THE INVENTION

It is therefore an object of the present invention to provide an adhesive tape holder which is made of light materials, such as plastic, and has a simple construction.

It is another object of the present invention to provide an adhesive tape holder on which a roll of adhesive tape is symmetrically supported so as to reduce the possible deformation of the holder structure.

It is a further object of the present invention to provide an adhesive tape holder which comprises a safety lid used to cover the knife to prevent the user from being hurt when the knife is not in use.

To achieve the above-mentioned objects, there is provided an adhesive tape holder comprising a base cylinder constituted by two cylinders releasibly connected together end by end. Each of the cylinders has an extension and the ends of the extensions are connected together by a knife seat with a saw-like knife mounted thereon. One of the extensions is constituted by two parts hinged together so that the cylinder associated therewith can be released and open to have a roll of adhesive tape disposed on the base cylinder. The saw-like knife is covered by a slidable safety lid to prevent the knife from hurting the user when not in use. Attached on one of the extensions is a tape tip retaining post which is rotatable in only one direction so as to prevent the tape tip from losing contact with the post.

Other objects and advantages of the invention will be apparent from the following description of the preferred embodiment taken in connection with the accompanying drawings wherein:

DETAILED DESCRIPTION OF THE PREFERRED EMBODIMENT

Figure 1:
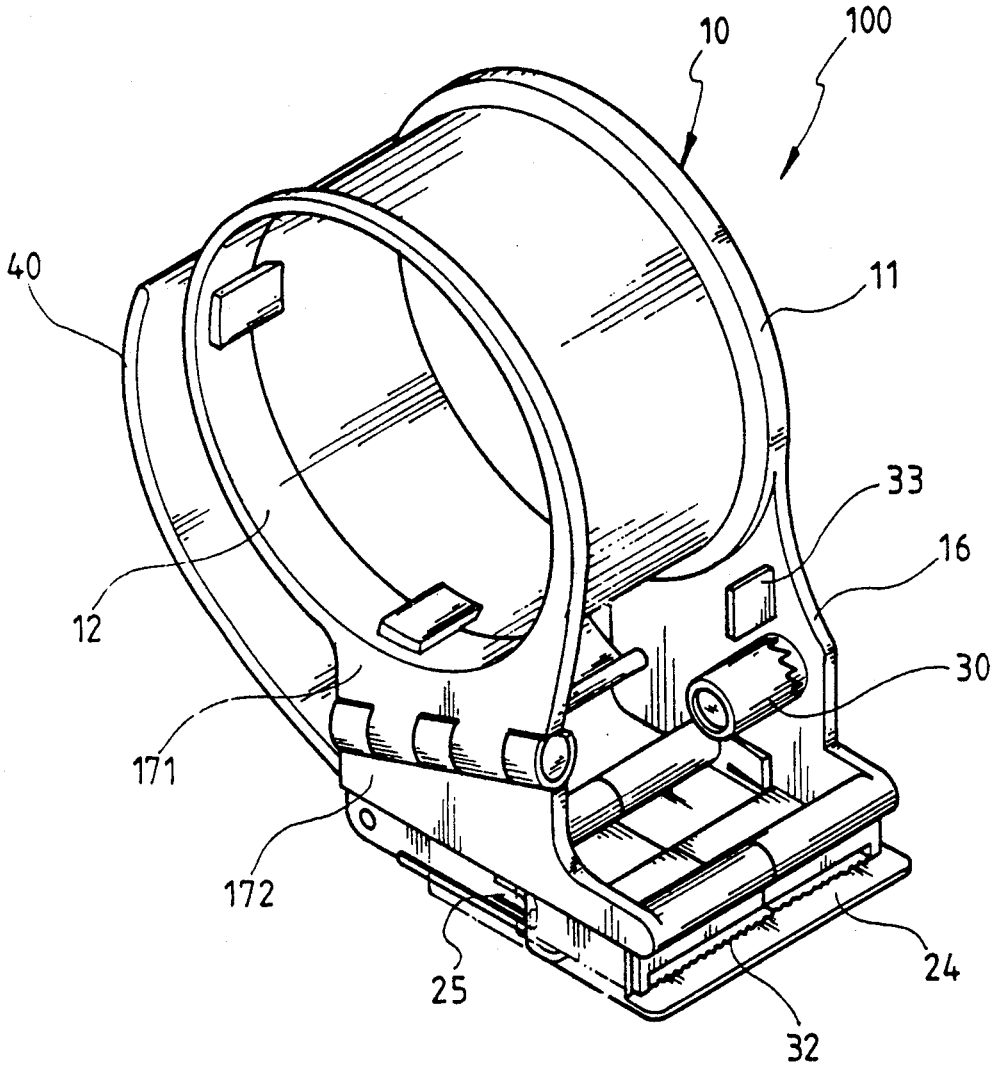
FIG. 1 is a perspective view of an adhesive tape holder in accordance with the present invention.
Figure 2:
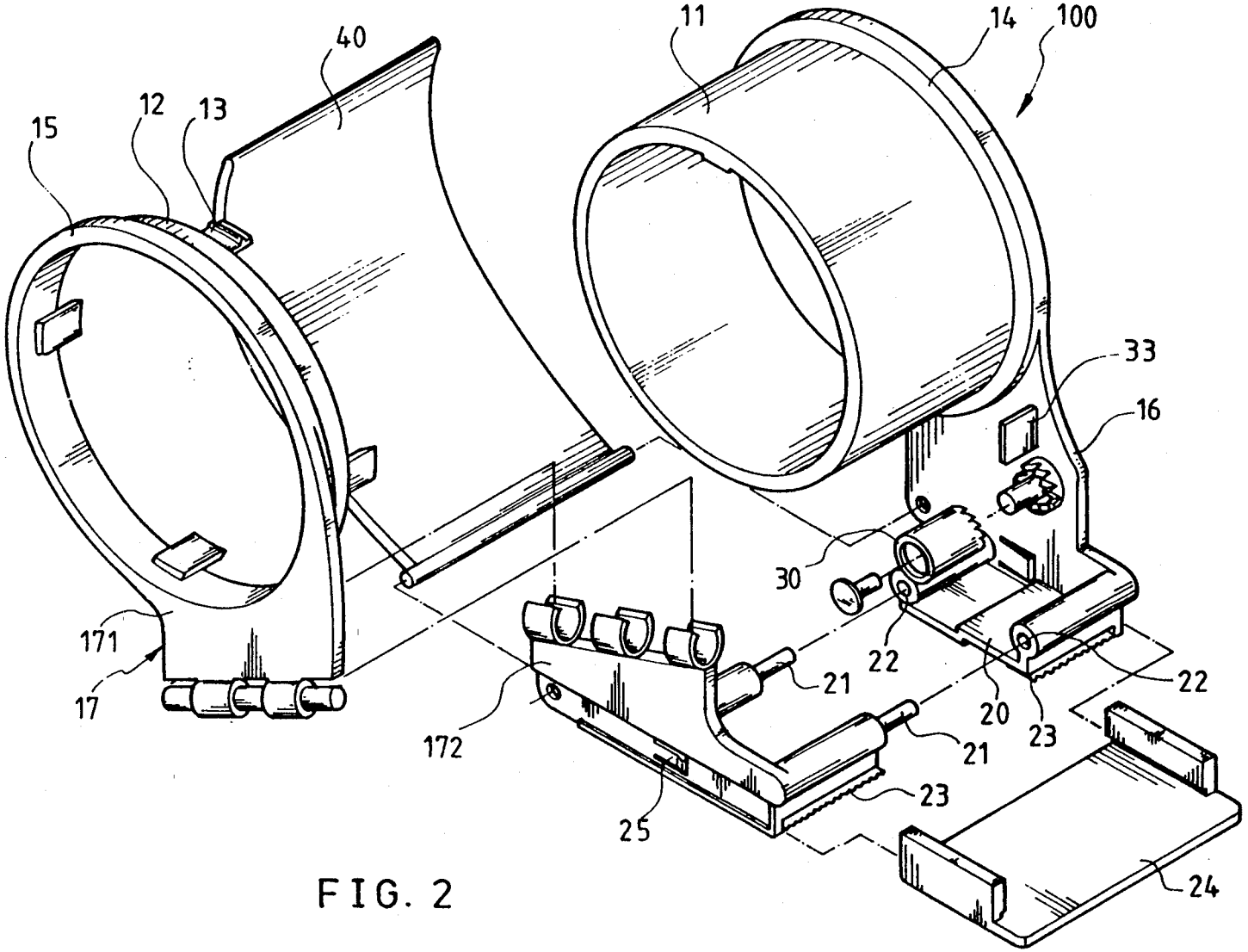
FIG. 2 is a fragmentary view of the adhesive tape holder shown in FIG. 1.
Figure 5:
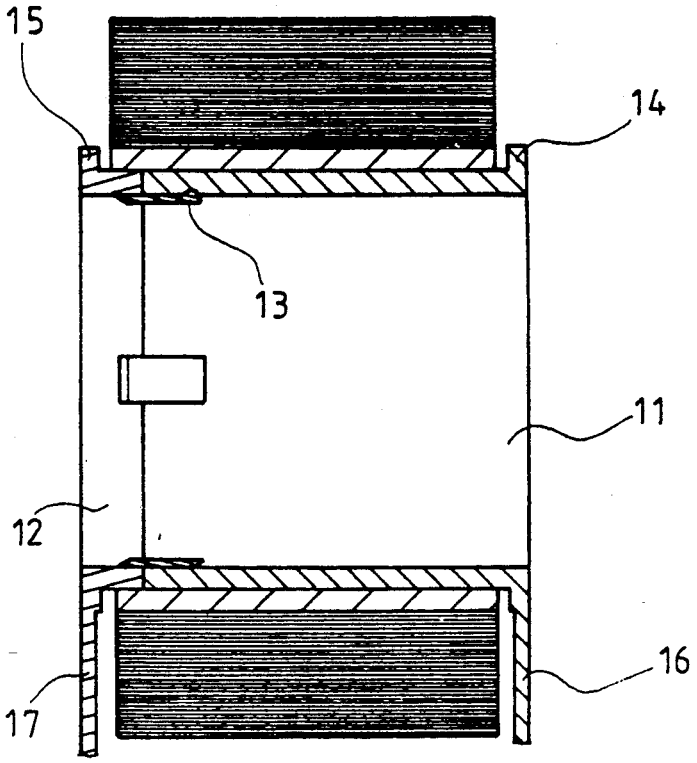
FIG. 5 is a cross-sectional view of the adhesive tape holder shown in FIG. 1 showing the detailed construction of the short cylinder on which the adhesive tape is disposed.

With reference to the drawing and in particular to FIGS. 1 and 2, an adhesive tape holder in accordance with the present invention, generally designated with the reference numeral 100, comprises a base cylinder 10 which is constituted by a first cylinder 11 having a length approximately equal to the width of a roll of adhesive tape (not shown) and a second cylinder 12 which is much shorter than the first cylinder 11. Both the first and the second cylinders 11 and 12 are fixed together end by end with a resilient snap catch 13 (also see FIG. 5) so as to be releasible with respect to each other. The first cylinder 11 has a first circumferential flange 14 and similarly the second cylinder 12 has a second circumferential flange 15 so that when they are fixed together, the flanges 14 and 15 define a space therebetween for receiving and holding the adhesive tape therein.

The first cylinder 11 has a first extension 16 which constitues partly the first circumferential flange 14. The second cylinder 12 has a second extension 17 which is constituted by a first part 171 and a second part 172 hinged together so that the first part 171 and thus the second cylinder 12 is rotatable with respect to the second part 172. The first part 171 constitutes in part the second circumferential flange 15. The first and second extensions 16 and 17 are opposing each other and extended to such a length that the roll of adhesive tape can be completely received therebetween.

Figure 4:
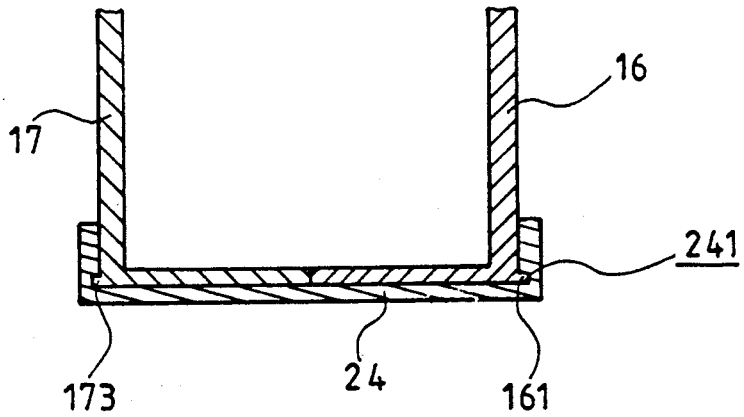
FIG. 4 is a cross-sectional view of a safety lid of the adhesive tape holder shown in FIG. 1 showing the detailed construction thereof.

A knife seat 20 is formed on the ends of the first and second extensions 16 and 17 and connecting therebetween. The knife seat 20 is constituted by two parts, one formed at the end of the first extension 16 and the second at the end of the second extension 17. The knife seat 20 is jointed together by a plurality of connecting projections 21 formed on one of the extensions 16 and 17 which are received and kept inside a plurality of counterpart holes 22 formed on the other one of the extensions 16 and 17. Attached on the outer surface of the knife seat 20 is a saw-like knife 23 which is also constituted by two parts. A safety lid 24 which is slidably mounted on the knife seat 20 is slidable from a first position where the sharpened edge of the knife 23 is covered by the lid 24 to prevent the knife 23 from accidently hurting a user (not shown) to a second position where the sharpened edge of the knife 23 is exposed for cutting the adhesive tape. A releasible retaining means 25 is devised to prevent the lid 24 from being accidently moved away from the first position. Also referring to FIG. 4, the extensions 16 and 17 has a strip of projections 161 and 173 formed thereon which are respectively received inside a slot 241 formed on the lid 24 to guide the sliding movement of the lid 24.

With the ends of the first and second extensions 16 and 17 jointed together and the first part 171 of the second extension 17 hinged on the second part 172 of the second extension 17, the second cylinder 15 which is releasibly connected to the first cylinder 14 with the snap catch 13, the second cylinder 15 is releasible and rotatable with respect to the first cylinder 14 to open and have the roll of adhesive tape received into the tape holder 100 or withdrawn from the tape holder 100.

A back cover 40 is pivotally mounted between the first and the second extensions 16 and 17 to cover the adhesive tape disposed on the adhesive tape holder 100.

Figure 3:
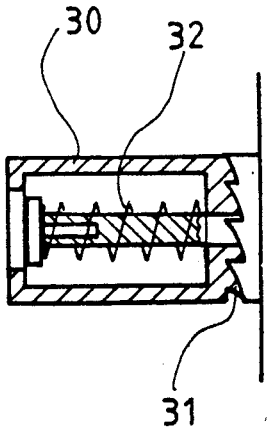
FIG. 3 is a cross-section view of a retaining post of the adhesive tape holder shown in FIG. 1 showing the detailed construction thereof.

To retain the tip of the adhesive tape, a rotatable post 30 is attached on the first extension 16. Further referring to FIG. 3, the post 30 has a ratchet portion 31 and is biased by a spring 32 so that it is free to rotate in one direction only. When a strip of the adhesive tape is pulled off the roll, the tape will pass and contact the rotatable post 30 and when the strip is further pulled off, the movement of the tape will also rotate the post 30 because of the adherence between the tape and the post 30. After the tape is cut off, the tip of the uncut tape still adheres to the post 30 for the next use. For further guiding the movement of the tape, a guiding strip 33 is fixed on the first extension 16 in the proximity of the rotatable post 30. The guiding strip 33 also provides the function of retaining the tip of the uncut tape.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. An adhesive tape holder comprising:

a base cylinder which is constituted by a first cylinder having a length approximately equal to a width of a roll of adhesive tape and a second cylinder which is shorter than said first cylinder and is releasably connected to the first cylinder with a connector to form said base cylinder;

a first extension and a second extension which are respectively formed on said first and second cylinders and opposing each other, said second extension being constituted by two portions hinged together so that the second cylinder along with one of said two portions is rotatable with respect to the other of said two portions;

a knife seat which is constituted by two parts each of which is formed on a far end of one of the first and second extensions and jointed together with a joint so as to form a connection between said far ends of the first and second extensions, said knife seat having a knife with a sharpened edge mounted thereon;

a safety lid which is mounted on the far ends of the first and second extensions and slidable from a first position to where said knife is covered by said safety lid to a second position where said knife is not covered thereby and thus exposed;

a tape tip retaining post which is rotatably formed on said first extension and is biased by a spring to have a ratchet portion thereof engaged to allow said post to be rotatable in only one direction;

a guiding strip which is formed on said first extension in the proximity of said tape tip retaining post to guide said adhesive tape and help retain the tip of said adhesive tape; and a back cover which is pivotally disposed between said first and second extensions to cover said roll of adhesive tape.

2. An adhesive tape holder as claimed in claim 1 wherein said connecting means used to releasably connect said first and second cylinders is a snap catch.

3. An adhesive tape holder as claimed in claim 1 wherein said jointing means for jointing said two parts of said knife seat is a plurality of holes for respectively receiving therein a plurality of projections.

4. An adhesive tape holder seat as claimed in claim 1 wherein both said first and second extensions have a strip of projection to be respectively received inside a slot formed on said safety lid to guide the movement thereof.

5. An adhesive tape holder comprising a base cylinder which is constituted by a first cylinder having a length equal to a width of a roll of adhesive tape and a second cylinder which is shorter than the first cylinder and is releasably connected to the first cylinder with a connecting means to form said base cylinder, a first extension and a second extension which are respectively formed on said first and second cylinders and opposing each other, a knife seat which is constituted by two parts each of which is formed on a far end of one of the first and second extensions and jointed together with a joint so as to form a connection between said far ends of the first and second extensions, said knife seat having a knife with a sharpened edge mounted thereon and characterized in that said second extension is constituted by two portions hinged together so that said second cylinder along with one of said two portions is rotatable with respect to said first cylinder when said second cylinder is released from said first cylinder.

6. An adhesive tape holder as claimed in claim 5 wherein said jointing means for jointing said two parts of said knife seat is a plurality of holes for respectively receiving therein a plurality of projections.

7. An adhesive tape holder as claimed in claim 5 wherein both said first and second extensions have a strip of projection to be respectively received inside a slot formed on said safety lid to guide the movement thereof.

* * * * *